US005096192A

United States Patent [19]

Stanford, Jr.

[11] Patent Number: 5,096,192

[45] Date of Patent: Mar. 17, 1992

[54] MINIATURE BOWLING GAME

[76] Inventor: Calvin J. Stanford, Jr., 2915 Anniston Rd., Jacksonville, Fla. 32216

[21] Appl. No.: 717,376

[22] Filed: Jun. 19, 1991

[51] Int. Cl.[5] ..... A63D 3/00; A63D 3/02

[52] U.S. Cl. ..... 273/39; 273/38

[58] Field of Search ..... 273/37, 38, 39

[56] References Cited

U.S. PATENT DOCUMENTS 1,268,741 6/1918 McCoy ..... 273/38
1,329,952 2/1920 Bond ..... 273/38
2,549,399 3/1951 Lund ..... 273/39
3,059,924 10/1962 Brown ..... 273/37
3,951,408 4/1976 Reiner et al. ..... 273/38

*Primary Examiner*—William H. Grieb
*Attorney, Agent, or Firm*—Steven R. Scott

[57] ABSTRACT

A bowling game table featuring a lane surface having a bilaterally symmetrical central trough which, beginning at a point proximate the edge from which the ball is rolled toward the pins, gradually expands in width and increases in depth until it reaches a maximum depth, and continues expanding in width until it spans the entire width of the lane surface while maintaining said maximum depth.

20 Claims, 2 Drawing Sheets

MINIATURE BOWLING GAME

BACKGROUND OF THE INVENTION

1. Field of the Invention

This invention involves a unique configuration for a miniature bowling alley and game. Thus, the invention touches, in general fashion, on the fields of both bowling and game tables. However, it can be more specifically and exactly classified as part of the field of miniature bowling games/tables.

2. Description of the Prior Art

Numerous patents, both design and utility, have been granted in the field of bowling type game tables. The following patents were review in advance of filing this application:

| | Patent Number |
|---|---|
| Utility Patents | |
| 1. Bowling Alley | 623,933 |
| 2. Divided Tenpin | 814,257 |
| 3. Foldable Game | 1,270,359 |
| 4. Bowling Pin | 1,491,279 |
| 5. Collapsible Bowling Alley | 1,581,423 |
| 6. Amusement Device | 1,977,739 |
| 7. Bowling Pin | 2,105,045 |
| 8. Bowling Pin | 2,119,310 |
| 9. Bowling Game Board | 2,453,610 |
| 10. Bowling Back Rack | 2,633,359 |
| 11. Game Device | 2,673,637 |
| 12. Bowling Game Device | 2,946,590 |
| 13. Magnetic Electric Switch For Games | 2,966,561 |
| 14. Ball Game Device | 3,438,632 |
| 15. Tiltable Electric Game Box | 3,452,987 |
| 16. Bowling Type Game | 3,841,632 |
| 17. Simulated Bowling Game | 4,008,893 |
| 18. Bowling Game | 4,220,332 |
| 19. Bowling Ball Game | 4,283,049 |
| 20. Method of Scoring Pocket Billiard Bowling | 4,817,945 |
| 21. Bowling Lane and Method of Repairing Same | 4,910,073 |
| 22. Slot Ball Game | 4,968,035 |
| 23. Game Board for Practicing Aspects of Bowls, Billiard and Pentaque | 4,986,542 |
| Design Patents | |
| 1. Design for Toy Bowling-Alley | D58,686 |
| 2. Design for a Bowling Alley | D108,730 |
| 3. Design for a Bowling Alley | D116,035 |
| 4. Design for a Bowling Alley | D120,117 |
| 5. Design for a Bowling Ball Rack or the Like | D132,212 |
| 6. Bowling Game Table | D160,923 |
| 7. Housing for Bowling Games and the Like | D165,961 |
| 8. Bowling Game Device | D170,664 |
| 9. Amusement Games Apparatus | D181,093 |
| 10. Bowling Game Apparatus | D183,725 |
| 11. Bowling Game Table | D189,397 |
| 12. Toy Bowling Pin Support | D192,087 |
| 13. Bowling Game Table | D197,977 |
| 14. Bowling Game Table | D217,566 |
| 15. Bowling Game Table | D219,154 |
| 16. Bowling Games Apparatus | D226,860 |
| 17. Bowling Alley | D279,693 |

Although many of these patents involve miniaturized bowling/bowling games tables, none teaches a uniquely curved miniature bowling lane of the type described by the inventor which, in combination with the other features of this invention, allow the user to experience many of the challenges faced in full-scale bowling.

SUMMARY AND OBJECTS OF THE INVENTION

The instant invention seeks to duplicate, in most respects the features and challenges offered by a full scale bowling alley in a miniature format. It is able to accomplish this object primarily due to the unique curvature given to the surface of the lane provided. However, it is assisted in accomplishing this goal by the inventor's provision of means for adjusting the tilt or incline of the alley, his provision of a simple and practical means for altering and controlling the angle and speed of the ball launched, and by his inclusion of other features that assist the players and add realism to the format.

In full scale bowling the bowling ball is launched toward a set of ten bowling pins at the opposite end of the lane. The lane surface in full scale bowling is straight and flat from the foul line to the pins. However, the bowler very seldom launches a bowling ball in a straight line toward the pins. First, it is almost impossible to launch a bowling ball without some degree of spin. Second, a straight, non-curving trajectory is not necessarily more advantageous to the bowler. Many of the shots practiced and much of the challenge of the game is based on the curve given to the ball's trajectory. As a rule, the right handed bowler will, without even trying, impart a counter-clockwise rotation to the ball, causing the ball to curve from right to left. Likewise, a left handed bowler normally imparts a clockwise rotation, creating a curve from left to right. All bowlers practice to control what begins as an unintended natural phenomenon, and learn to control the spin/curve of the ball with great accuracy. Thus, a vast number of trajectories may be obtained by an experienced bowler.

In the instant invention, the same options are possible due to the nature of the lane surface. The lane surface is uniquely constructed utilizing various contours that range from flat, to slightly concave, to a more pronounced bowl-type contour before slowly rising to return to a flat triangular section where the pin deck is located. This curvature allows the player to select from a number of shots in approaching the pins, ranging from a straight ball down the center of the lane to a hard breaking curve ball from either right to left or left to right depending on the target. If a right to left curve is desired the ball is launched down the right side of the lane. The contour will then cause a right to left curve. The further to the right the ball is launched, the more that it will break back to the left. The same techniques may be used on the opposite side of the lane if a left to right curve is sought. The straight ball may be obtained by launching the ball directly down the center of the lane. This will send the ball down the bottom of the contour. A straight ball may also be used to shoot cross-lane in attempting a corner pin spare as in the sport of bowling.

The sport of bowling is made even more challenging by altering the conditions of the lane through application of oil on certain sections of the lane surface. The more oil is placed on the lane, the less friction is created between the ball and the lane surface. This causes the bowling ball to curve less. As the amount of oil decreases, friction increases, and the tendency of the ball to curve is, likewise, greater.

Although there is never any oil used on the lane provided in the instant invention, similar effects may be created and conditions may be otherwise changed by use of adjustable foot pads on each leg. A player may become very proficient with the table and the angles necessary to use in playing the game. This can create an unfair advantage or monotony for the participants. By use of the adjustable footpads, it is a simple procedure to raise one side of the table over the other. This completely changes the game for all concerned. For example, if you raise the left side of the table, the ball will curve more from left to right, and less from right to left. You may also affect lane conditions by raising or lowering the ends of the table. By raising the end where the pins are located, a slight incline is created. As the ball is launched, this incline slows the ball slightly and allows the contours of the alley surface to more strongly affect the trajectory of the ball, causing greater curvature from both sides of the lane. If the other end of the table is raised, the ball's speed will be increased, causing less curve from either side. Thus, just as in the sport of bowling, the players may be given an almost unlimited variety of conditions, insuring variety and challenge for players of all ages and skills.

DETAILED DESCRIPTION OF THE PREFERRED EMBODIMENT

Figure 2:
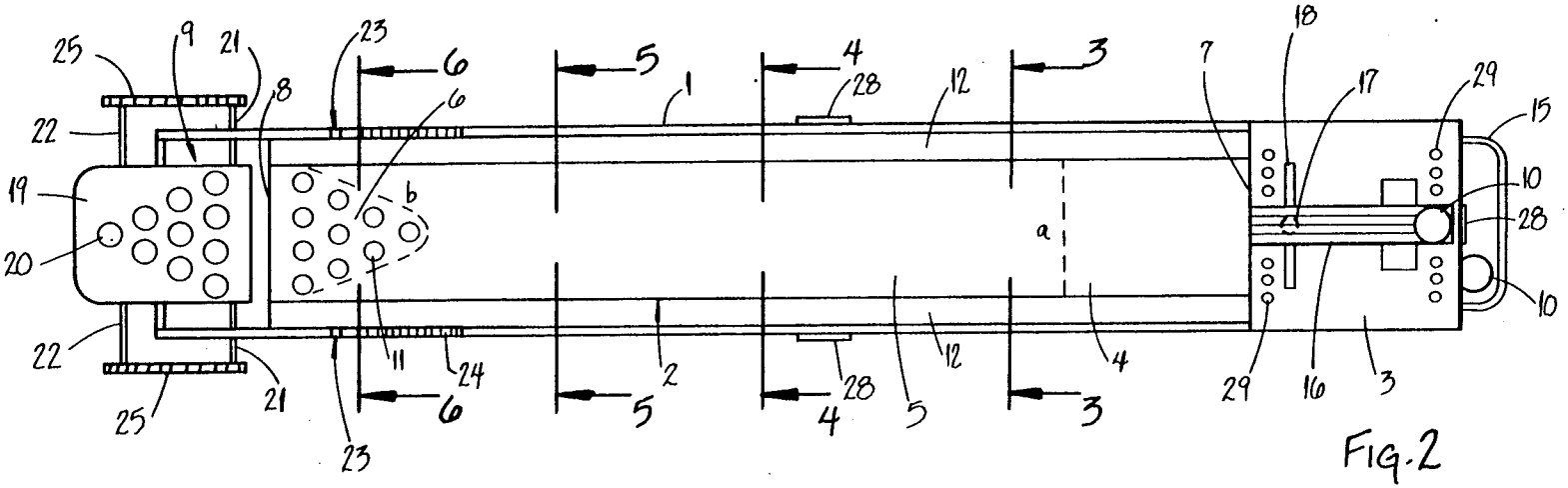
FIG. 2 provides an over-head view of the instant invention.
Figure 1:
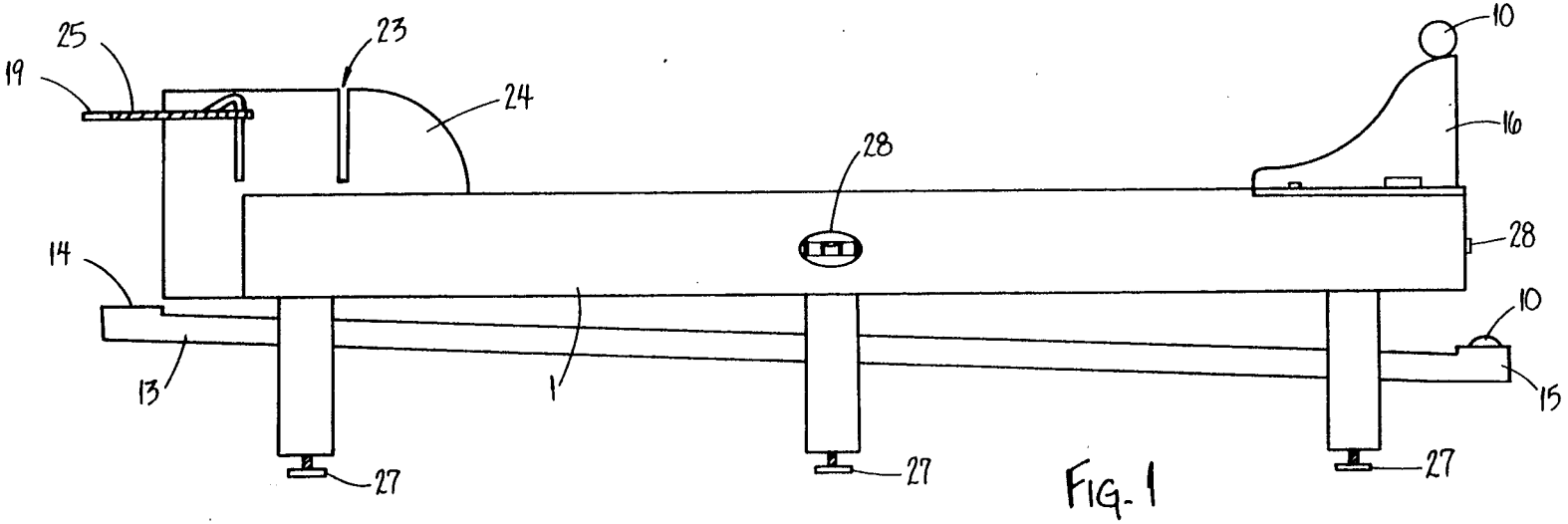
FIG. 1 provides a side view of the instant invention.

FIG. 1 and FIG. 2 illustrate, respectively, the bowling table 1 taught by this invention rom the side and from above. The alley 2 can, in general, be divided into four portions: A ball launching portion 3, which corresponds in general to the area of a full scale bowling alley from which the bowler launches the ball; a flat portion 4, which may be of various lengths without adversely affecting the function of the invention; a troughed portion 5, which produces effects similar to those produced by the spin of the ball in full scale bowling; and a pin bearing portion 6, which is flat and somewhat triangular in outline. The approximate boundary between portions 4 and 5 is indicated by the broken line "a". The approximate boundary between portions 5 and 6 is indicated by broken line "b".

The line between the ball launching portion 3 and the flat portion 4 designates the first edge 7 of those portions of the alley 2 that corresponds with the lane of full scale bowling: Flat portion 4 and troughed portion 5, together with pin bearing portion 6. The second edge 8 indicates the boundary of the alley 2 opposite the first edge 7. A bin 9 is located adjacent to and below the second edge 8 to catch any balls 10 that cross the second edge 8 as well as any pins 11 that may be knocked over. (Only pin 11 is labelled to avoid a confusing duplication of reference numbers and crowding of the figures; however, it will be understood that all of the circles inscribed in portion 6 represent pins 11).

The table 1 is also provided with gutters 12 (as in full scale bowling) which open into the bin 9 and are inclined such that a ball 10 crossing over one of the side edges of the alley 2 and entering the gutter 12 will roll down towards, and be emptied into the bin 9. A return gutter 13 is provided below the table 1 with its entry 14 at the end of the table adjacent to the second edge 8. The return gutter 13 slopes downward to a ball rack 15 located below and adjacent to the ball launching portion 3 such that a ball entering the return gutter 13 at its entry 14 will automatically roll down into and be contained by the ball rack 15 where it is easily accessible to game players. Models have been made where the bin 9 is constructed so as to automatically funnel the ball 11 to the entry 14; however, where manual pin spotting techniques and mechanisms are used and provided, it has been determined that the configuration shown is just as suitable.

The ball may be manually launched; however, it has been found that this invention can be more simply and effectively utilized when some simple, aimable launching means is provided. This launching means needs to be freely aimable, and capable of providing a freely adjustable impetus to the ball so that the player can, by propelling the ball at varying speeds and angles, fully exploit the variety of shots that are available for bowlers on a full scale lane. In the instant embodiment, a ramp 16 is provided which may be rotated freely on a pivot 17. The pivot 17 is slidably anchored in a slot 18 so that the ramp 16 may be moved from side-to-side in the ball launching portion 3. For each position chosen, the ramp 16 may also be freely rotated on its pivot 17 so as to allow the ball to be launched from varying angles. The velocity of the ball can be simply and efficiently controlled by releasing it from different heights on the ramp 16.

For ease in placement ("spotting") of pins 11, a pin spotter 19 is provided. As illustrated in FIGS. 1 and 2, the pin spotter 19 is a flat, relatively thin member having circular perforations 20 slightly greater in diameter than the pins utilized. (Only one perforation 20 if labelled to avoid a confusing proliforation of reference numbers; however, it will be understood that all of the circles in pin spotter 19 represent perforations 20). When not in use, it is rotated back on the spotter pivot 21 so as to cover the bin 9. To put it into use, it is raised and rotated forward on the spotter pivot 21 so that it is above the pin bearing portion 6. From this position, it may be dropped directly downward to a resting position only slightly above the pin bearing portion 6. Guiding rods 22 are provided on each side of the pin spotter 19 to assure that the pin spotter 19 moves straight up and down for at least the distance necessary to bring it above the pins 11 before it can be rotated backward on the spotter pivot 21. These rods 22 enter the slots 23 located in the sides of the bin section 24 when the pin spotter 19 is allowed to drop down over the pin bearing portion 6. With the pin spotter 19 in this position, the pins 11 can be quickly and easily returned to their positions on the pin bearing portion 6 by inserting their base through the perforations 20 and leaving them standing on the pin bearing portion 6. The pin spotter 19 is then returned to its resting position over the bin 9. Handles 25 have also been provided at the sides of the pin spotter to assist the user. The simple manual system illustrated can, of course, be replaced by more complex mechanical and electronic pin spotting and scoring mechanisms of the type well known in the art. However, the system illustrated has the virtue of simplicity and is easy to manufacture and use. Lighting has also been added in some models to illuminate the pins 11 in their standing location. This also adds to the realism of the format.

FIGS. 3, 4, 5, and 6 illustrate the unique and novel cross-section given to the concave portions of the alley 2 of the instant invention. As previously noted, the flat portion 4 may be of various lengths without adversely affecting the function of the invention. In the embodiment shown, it is approximately 24 inches in length. It can be shortened considerably or even eliminated. However, in full scale bowling, the effect of spin on the ball's trajectory is not generally obvious until the ball has traveled some distance down the alley. Thus, including a flat portion 4 in the alley 2 allows the invention to more closely replicate the experience of full scale bowling. In the embodiment shown and discussed, the alley 2 (as measured between the first edge 7 and the second edge 8) is approximately 96 inches long. It is 9 $\frac{1}{8}$ inches wide. The weight and dimensions of the various components should, ideally, be proportionate to those utilized in full scale bowling. Thus, the pins should be in substantially the same proportion to the size and weight of the ball used as the size and weight of full-scale pins are to full-scale bowling balls. Likewise, the length and width of the alley 2 should be in the same proportions as the length and width of a full-scale bowling alley. However, wide variation in dimension is possible without exceeding the ambit of this invention.

Figure 3:
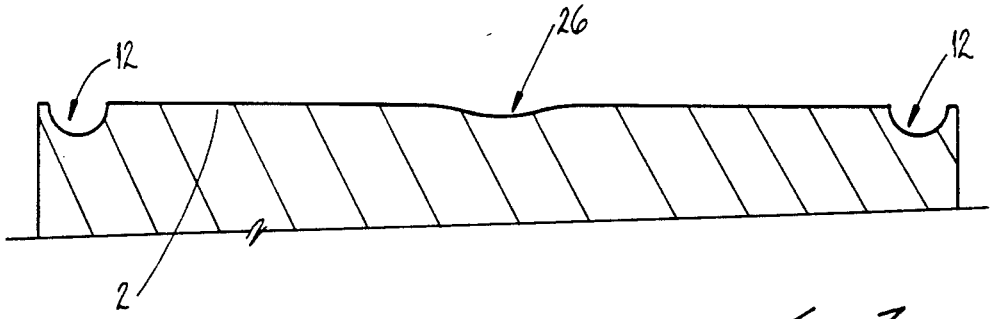
FIG. 3 provides a cross-sectional view of the alley of the instant invention taken along the line 3—3 of FIG. 2.
Figure 4:
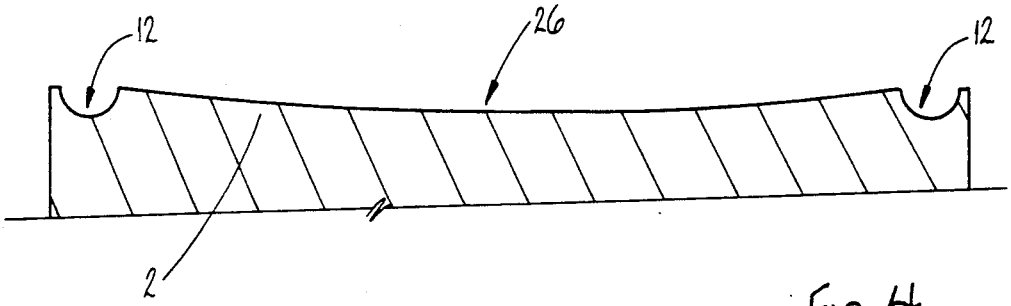
FIG. 4 provides a cross-sectional view of the alley of the instant invention taken along the line 4—4 of FIG. 2.
Figure 5:
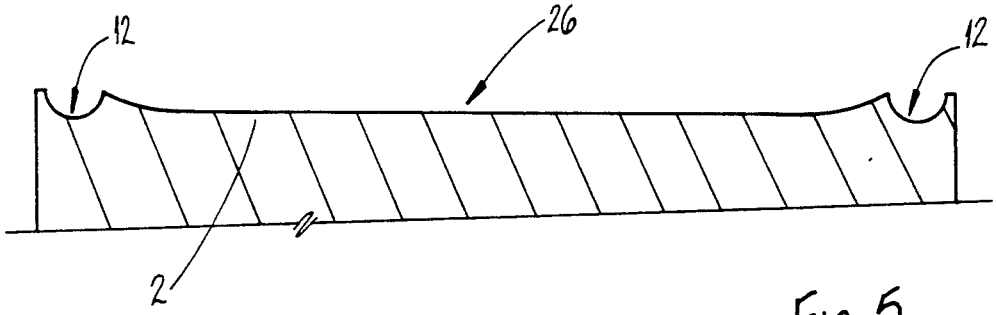
FIG. 5 provides a cross-sectional view of the alley of the instant invention taken along the line 5—5 of FIG. 2.
Figure 6:
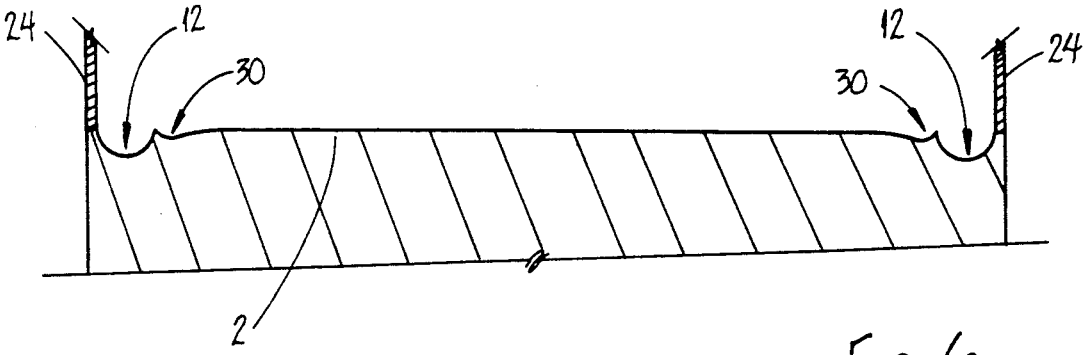
FIG. 6 provides a cross-sectional view of the alley of the instant invention taken along the line 6—6 of FIG. 2.

As shown in FIG. 3, the troughed portion 5 has a central concavity 26 which begins at a point adjacent to the flat portion 4, and gradually develops in the center of the alley 2. As it moves away from the flat portion 4, the concavity 26 becomes both wider and deeper. At a point approximately 80 inches from the first edge 7, it reaches a maximum depth of approximately one quarter inch ($\frac{1}{4}$"). As illustrated in FIG. 4, the width of the concavity 26 gradually expands until it completely spans the distance between the gutters 12. The bottom of the concavity 26 gradually becomes flatter as it reaches its maximum depth. Thus, as illustrated in FIG. 5, the concavity 26 begins to develop a more "bowl-like" shape with steeper sides (than those shown in FIGS. 3 or 4) as it approaches the pin bearing portion 6. In the embodiment shown, the depth of the concavity 26 then begins to gradually decrease as it approaches the triangle shaped pin bearing portion 6, which is at the same level as the flat portion 4. As it advances toward the second edge 8, the bottom of the concavity 26 must rise first to meet the point of the pin bearing portion 6 which is closest to the first edge 7. This results, as illustrated in FIG. 6, in the creation of two subtroughs 30 adjacent to the sides of the pin bearing portion 6.

The pin bearing portion 6 need not, however, be at the same level as alley 2 for this invention to function properly. Further, numerous other changes can be made to the contour and configuration of the concavity 26 without exceeding the spirit and scope of this invention and the claims. The inventive concept embodied herein comprehends any bowling-type games with an alley having a bilaterally symmetrical central concavity running from a point proximate to the first edge 7 to a point proximate the second edge 8, where the central concavity gradually expands in width and depth as it moves toward the second edge 8 until it reaches a maximum depth, and has a bottom that becomes progressively flatter and sides that become progressively steeper as it moves toward the second edge.

In addition to the foregoing features, the bowling table 1 may be advantageously provided with adjustable (screw threaded) pads 27 that allow it to be tilted or inclined. Bubble-type levels 28 are also a useful addition as they assist in both leveling the table 1 and in monitoring the degree and informity of the tilt or incline given to the table 1 via pads 27. Finally, spotting markers 29, which may consist of circular indentations in the surface of the ball launching portion 3 as shown, are provided in this embodiment to assist visually handicapped players to correctly position the ramp 16. (Not all of the markers 29 are numbered to avoid needless duplication of reference numerals; however, it will be understood that all of the small circles in the ball launching portion 3 which are identical to those labelled "29" are markers 29).

What is claimed is:

1. A bowling-type game, comprising:

a) A ball;

b) A substantially rectangular lane surface which is defined by four perimeter edges, a first edge from which said ball may be launched so as to roll on said lane surface toward a second edge opposite therefrom where the distance between said first edge and second edge is greater than the distance between the remaining two side edges, and has a bilaterally symmetrical central trough which extends linearly between points proximate to the first edge and points proximate to the second edge and which, beginning from a point proximate to the first edge, gradually expands in width and depth to a maximum depth, has a bottom that becomes progressively broader and flatter and sides that become progressively steeper, and then decreases in depth while maintaining said flattened bottom and more steeply sloping sides until it rises back to its original level at a triangular shaped area located adjacent to the second edge.

c) A target element disposed proximate to the second edge of said lane surface so that it may be contacted by the ball when launched from the first edge in such a manner as to roll along the lane surface to the second edge.

2. A bowling game as described in claim 1, wherein said target element consists of pin elements whose size and weight are in substantially the same proportion to the size and weight of the ball used, as the size and weight of bowling pins are to bowling balls.

3. A bowling game as described in claim 2, further comprising a means for repositioning the target element and all subparts the target element may have after collision between the ball and the target element.

4. A bowling game as described in claim 2, further comprising a means for spotting the pins at the appropriate location proximate to the second edge.

5. A bowling game as described in claim 1, wherein the length and width of the lane surface are in substantially the same proportion as the length and width of a bowling lane.

6. A bowling game as described in claim 1, wherein the target element consists of pin elements whose size and weight are in substantially the same proportion to the size and weight of the ball, as the size and weight of bowling pins are to bowling balls, and wherein the length and width of the lane surface is in substantially the same proportion as the length and width of the bowling lane.

7. A bowling game as described in claim 1, wherein a flattened area is provided on the lane surface proximate to the second edge thereof for the positioning of the target element.

8. A bowling game as described in claim 1, wherein the maximum depth of the central trough is approximately one quarter inch ($\frac{1}{4}$").

9. A bowling game as described in claim 1, further comprising a thrust element by which the ball may be aimed and launched toward the target element.

10. A bowling game as described in claim 9, wherein said thrust element is an aimable ramp which the ball may be allowed to roll down to gain velocity.

11. A bowling game as described in claim 1, further comprising troughlike alleys located adjacent to and along each side edge so as to capture and contain a ball which is launched in such a way as to leave the lane surface before reaching the second edge.

12. A bowling game as described in claim 1, further comprising a ball bin located below, adjacent to, and along the second edge so as to capture and contain a ball which is launched in such a way as to leave the lane surface by crossing the second edge, as well as to capture and contain any target element which, after being struck by the ball, leaves the lane surface by crossing the second edge.

13. A bowling game as described in claim 1, further comprising a ball rack proximate to and below the first edge which is capable of containing a multiplicity of balls.

14. A bowling game as described in claim 13, further comprising a ball return ramp having an entry point at its higher end, which is located proximate to the second edge, and which slopes downward and has it lower end in the ball rack such that a ball placed on the ramp at said entry point will automatically roll down into and be contained by said ball rack.

15. A bowling game as described in claim 1, further comprising means by which the level and incline of the lane surface may be changed and adjusted.

16. A bowling game as described in claim 1, further comprising means for determining whether the lane surface is level or inclined.

17. A bowling game as described in claim 1, wherein the lane surface is flat between the first edge and the points proximate to the first edge where the central trough begins.

18. A bowling game as described in claim 17, wherein the portion of the lane surface that is flat extends approximately one-quarter of the distance between the first edge and the second edge.

19. A bowling games as described in claim 1, wherein the lane surface is approximately 96 inches long and 9 $\frac{1}{8}$ inches wide.

20. A bowling game as described in claim 19 wherein the maximum depth of the central trough is approximately one-quarter inch ($\frac{1}{4}$"), the central trough begins approximately 24 inches from the first edge, and the lane surface is flat between the first edge and the beginning of the central trough.

* * * * *